United States Patent [19]

Jencks et al.

[11] 4,245,140

[45] Jan. 13, 1981

[54] MANUAL AND MOTOR OPERATED CIRCUIT BREAKER

[75] Inventors: Charles L. Jencks, Avon; Roger N. Castonguay, Terryville; Eric H. Rask, Newington, all of Conn.

[73] Assignee: General Electric Company, New York, N.Y.

[21] Appl. No.: 52,051

[22] Filed: Jun. 25, 1979

[51] Int. Cl.[3] ..... H01H 9/20; H01H 3/46; H01H 73/12

[52] U.S. Cl. ..... 200/153 G; 200/153 H; 200/153 SC; 335/68; 335/173

[58] Field of Search ..... 200/153 G, 153 SC, 153 H, 200/330; 335/17, 173, 68, 186

[56] References Cited

U.S. PATENT DOCUMENTS

| | | | |
|---|---|---|---|
| 3,234,804 | 2/1966 | Caswell | 335/68 |
| 3,559,121 | 1/1971 | Powell et al. | 335/68 |
| 4,001,742 | 1/1977 | Jencks et al. | 200/153 G |
| 4,042,896 | 8/1977 | Powell et al. | 335/173 |

*Primary Examiner*—Willis Little

*Attorney, Agent, or Firm*—Robert A. Cahill; Walter C. Bernkopf; Philip L. Schlamp

[57] ABSTRACT

A handle operator slide and a motor operator slide are individually coupled with a charging mechanism to independently charge charging springs thereof. The charging mechanism is operative to charge the springs of a contact operating mechanism as the charging springs discharge. The charging mechanism includes a prop controlled by the condition of the operating mechanism to releasably sustain the charging springs in a fully charged condition, while the operating mechanism includes a hook to releasably sustain the breaker contacts open against the urgence of fully charged operating mechanism springs. Consequently, the circuit breaker is capable of executing multiple contact opening and closing operations without recharging the charging springs by either the handle or the motor via their respective slides.

21 Claims, 13 Drawing Figures

MANUAL AND MOTOR OPERATED CIRCUIT BREAKER

REFERENCE TO RELATED APPLICATIONS

The disclosure of the instant application is common with the disclosure of commonly assigned, concurrently filed, applications, Ser. Nos. (52,276) and (51,587), which contain claims drawn to other inventions disclosed herein.

BACKGROUND OF THE INVENTION

The present invention relates to circuit breakers of the industrial type which are equipped with both a manual operating handle and a motor operator mechanism to afford the capability of either local manual circuit breaker operation or typically remotely initiated motorized circuit breaker operation. Such remotely initiated operation may be effected manually (by control switch actuation) or automatically in coordination with the operations of other equipment. Thus, motor operated industrial circuit breakers have particular application as, for example, process control switches having the added benefit of affording overcurrent protection.

Heretofore, circuit breakers designed for both manual and motorized operation have typically required electrical and/or mechanical interlocking such that upon initiation of manual circuit breaker operation, motorized circuit breaker operation is locked out or defeated, and vice versa. This is done to prevent damage to the circuit breaker and possible injury to operating personnel since the circuit breaker mechanisms simply cannot tolerate concurrent manual and motorized operations. Examples of such interlocking can be found in commonly assigned U.S. Pat. Nos. 3,559,121 and 4,042,896.

Obviously, the inclusion of such interlocking adds complexity and expense to the circuit breaker design, in addition to constituting a potential source of field problems. A related problem that may be posed by this interlocking involves the possible loss of power or a malfunction in the motor operator mechanism while motorized circuit breaker operation is in process. In this event, it is highly desirable to be able to remove or defeat the interlocking such as to permit manual completion of the interrupted motorized circuit breaker operation. Defeatable interlocking, if accommodatable by the circuit breaker mechanisms, contributes further to design complexity and expense. The alternative is to await restoration of power or to remedy the source of the motor operator malfunction in order to complete the circuit breaker operation, which typically is totally unacceptable.

It is accordingly an object of the present invention to provide an improved manual and motor operated circuit breaker.

Another object of the present invention is to provide a circuit breaker of the above character, wherein manual and motor powered circuit breaker operations are accommodated in non-interfering fashion.

A further object is to provide a circuit breaker of the above character, wherein special interlocking between manual and motor powered circuit breaker operations is avoided.

Yet another object is to provide a circuit breaker of the above character, wherein circuit breaker operation initiated by the motor may be readily completed manually and vice versa.

An additional object is to provide a circuit breaker of the above character wherein the manual and motor operating means incorporated therein are efficient in design, and both convenient and reliable in operation.

SUMMARY OF THE INVENTION

In accordance with the present invention, there is provided an improved manual and motor operated circuit breaker which does not require interlocking provisions to prevent concurrent manual and motorized circuit breaker operations. More specifically, the circuit breaker includes a manual operating handle and a motor operator mechanism which are operatively coupled to the circuit breaker operating mechanisms via separate operator members capable of individual, concurrent, and non-interfering operating movement. That is, the circuit breaker of the present invention can safely accommodate a "race" between the manual operator member and the motor operator member, both acting to operate the circuit breaker. Regardless of which operator member wins the race, circuit breaker operation is carried through to completion, i.e., by the winner. Thus, should motorized circuit breaker operation be interrupted prior to completion, the manual handle is simply operated to motivate its operator member, and the interrupted circuit breaker operation is picked up at the point where the motor operator member left off and carried through to completion.

In accordance with a more specific feature of the present invention, the circuit breaker is of the stored energy type equipped with a spring powered charging mechanism and a spring contact operating mechanism. The manual operator member and the motor operator member are separately, drivingly coupled with the charging mechanism pursuant to charging the charging springs thereof. The charging mechanism is, in turn, coupled with the contact operating mechanism such that the mechanism springs are charged as the charging springs discharge. Once charged, the mechanism springs are empowered to close and subsequently open the breaker contacts. A hook is included in the contact operating mechanism to releasably hold the breaker contacts open against the bias of charged mechanism springs. The charging mechanism includes a prop automatically conditioned by the contact operating mechanism to enable discharge of the charging springs only when the mechanism springs are discharged. Thus, charges may be concurrently stored in both sets of springs, rendering the circuit breaker capable of multiple contact closing and opening operations without recharging the charging springs by either the manual handle or the motor operator mechanism.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which:

DESCRIPTION OF THE DRAWINGS

Like reference numerals refer to like parts throughout the several views of the drawings.

DETAILED DESCRIPTION

Figure 1:
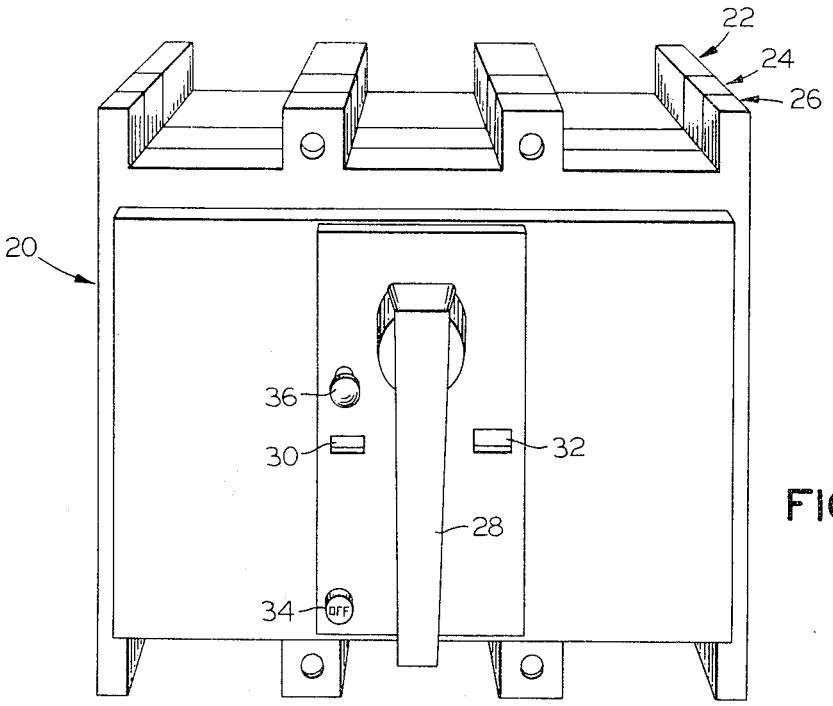
FIG. 1 is an isometric view of a molded case industrial circuit breaker embodying the present invention.

Referring to FIG. 1, the circuit breaker of the present invention, generally indicated at 20, consists of, in one version, three basic assemblies, namely, a circuit breaker assembly 22, a power unit assembly 24, and a cover assembly 26, all secured together in stacked relation. In this version, the circuit breaker is capable of both manual and motor powered operations. To provide a strictly manually operated circuit breaker, power unit assembly 24 is simply omitted, leaving the cover assembly 26 stacked directly atop the circuit breaker assembly 22. As will be seen from the description to follow, circuit breaker assembly 22 includes a contact operating mechanism having basically the same construction as that disclosed in commonly assigned U.S. Pat. No. 4,001,742. It will also be noted from the description to follow that power unit assembly 24 has many of the structural features disclosed in commonly assigned U.S. Pat. No. 4,042,896. The disclosures of both of these patents are specifically incorporated herein by reference.

Still referring to FIG. 1, cover assembly 26 includes a manual operating handle 28 which may be cranked to manually charge circuit breaker 20. The cover assembly also includes windows 30 and 32 through which indicators are visible to identify the existing condition of the circuit breaker. Manual controls for conditioning the circuit breaker include an OFF button 34 and an ON pushbutton 36. The OFF pushbutton is depressed to trip the circuit breaker assembly 22, causing the circuit breaker contacts to spring from their closed circuit position to their open circuit positions. The ON pushbutton is depressed to cause the breaker contacts to spring from their open circuit position to their closed circuit positions once the breaker contact operating mechanism has been charged either via the power unit assembly 24 or the manual handle 28.

Figure 3:
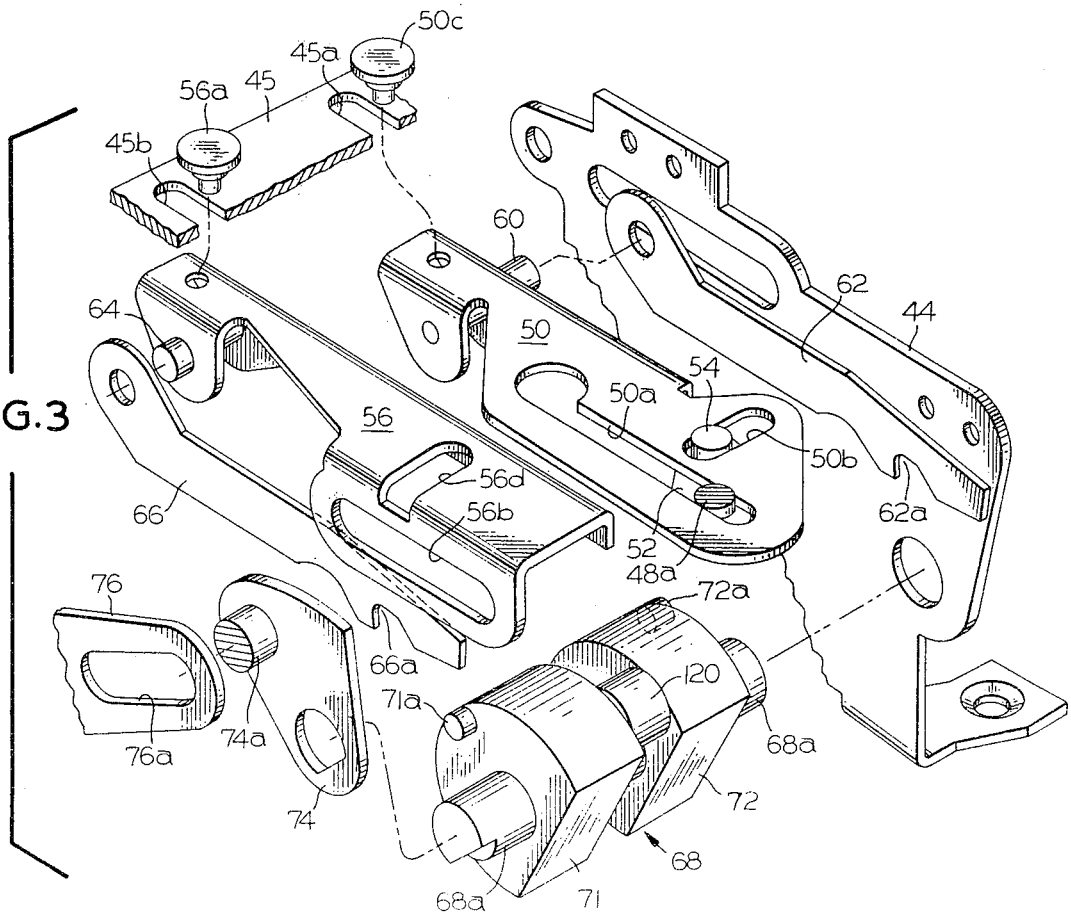
FIG. 3 is an exploded perspective view of a portion of the charging mechanism utilized in the circuit breaker of FIG. 1.
Figure 2:
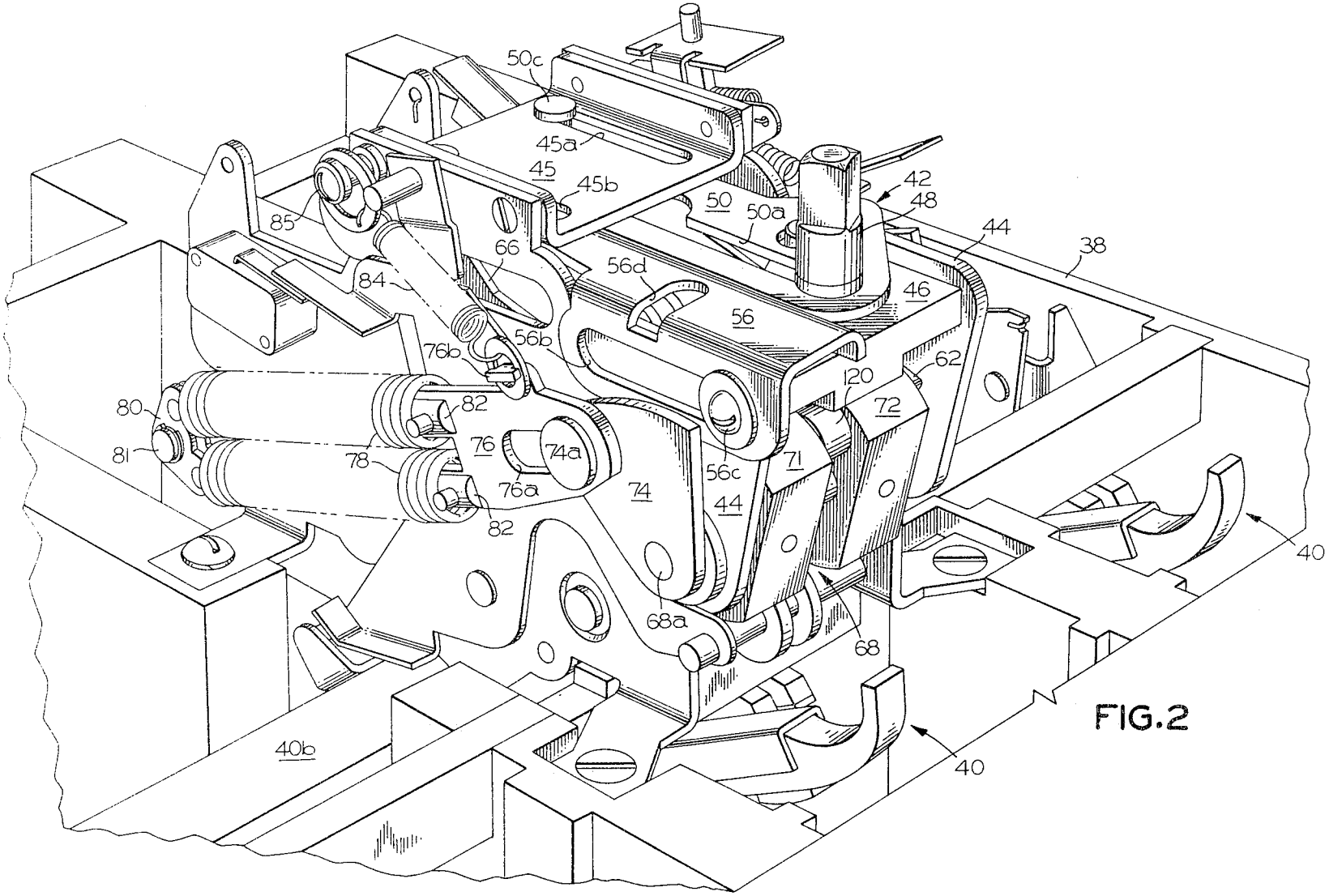
FIG. 2 is a perspective view of the overall operating mechanism utilized in the circuit breaker of FIG. 1.
Figure 10:
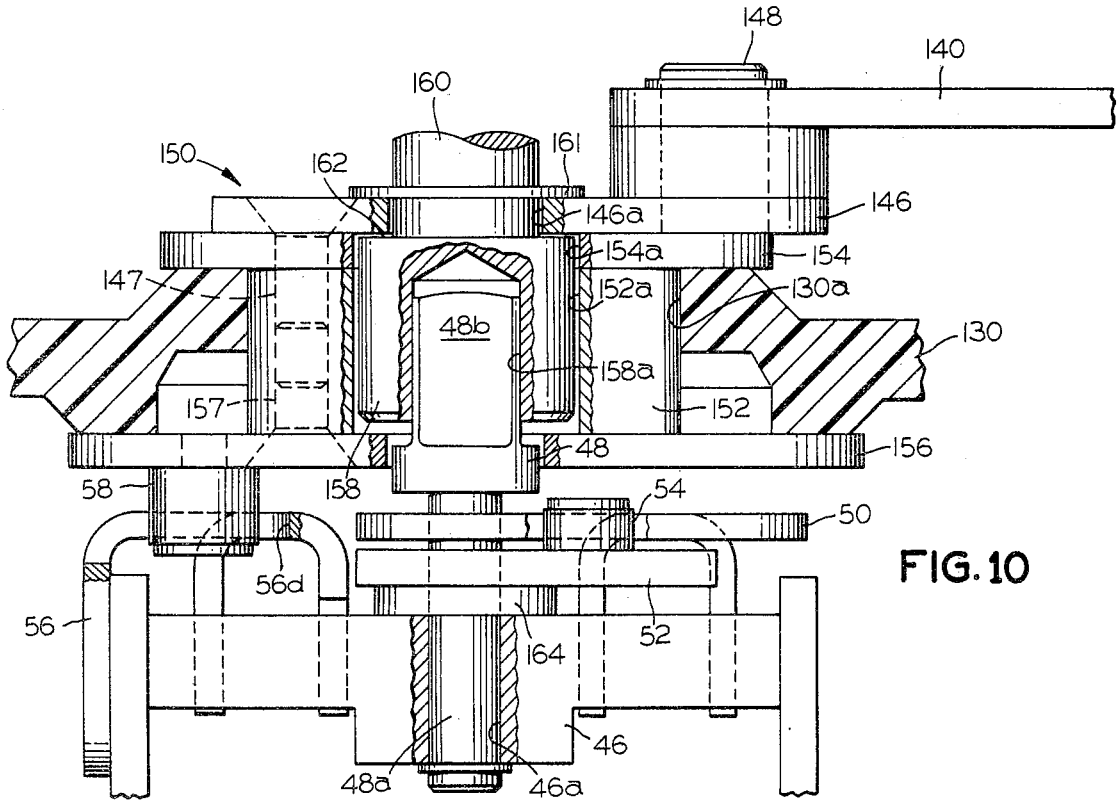
FIG. 10 is a sectional view of a hub assembly utilized in the circuit breaker of FIG. 1 to accommodate both manual and motor operator mechanism charging of the charging mechanism.

Circuit breaker assembly 22, seen in perspective in FIG. 2, includes a molded insulated base 38 in which three sets of movable contact assemblies 40 are mounted for pivotal movement between their open and closed circuit positions, preferably in the manner disclosed in the above noted U.S. Pat. No. 4,001,742. Base 38 also mounts a charging mechanism, generally indicated at 42, in the region generally above the center pole of circuit breaker 20. The various components of this mechanism are mounted by a frame consisting of a pair of parallel, spaced sideplates 44 spanned by a stringer plate 45 and a block 46. Block 46 serves to rotatably mount an upright stub shaft 48 which is drivingly coupled via a hub assembly seen in FIG. 10 to manual operating handle 28 of FIG. 1 and a motor operator mechanism seen in FIG. 8 and included in power unit assembly 24 of FIG. 1. As seen in FIGS. 3 and 10, the lower, reduced portion 48*a* of stub shaft 48 is received in a longitudinally elongated slot 50*a* formed in a manual operator slide 50. Fixed to shaft portion 48*a* is a crank arm 52 which carries at its free end an upstanding crank pin 54 operating in a transversely elongated slot 50*b* formed in slide 50. The rearward end of slide 50 carries a headed pin 50*c* which is received in an elongated slot 45*a* formed in stringer plate 45, thus completing the mounting of slide 50 to the mechanism frame.

As will be seen from the description to follow, counterclockwise rotation of shaft 48 by the handle swings crank arm 52 in the counterclockwise direction to propel slide 50, via pin 54 operating in slide slot 50*b*, through a rearward return stroke. Then, clockwise rotation of handle 28 back to its vertical position seen in FIG. 1 swings arm 52 in the clockwise direction, forcing slide 50 to execute a forward charging stroke.

Still referring to FIGS. 2 and 3, the mechanism frame additionally serves to mount in side by side relation with slide 50, a second, motor operator slide 56. This slide carries at its rearend a headed pin 56*a* which is received in an elongated slot 45*b* formed in stringer plate 45. The forward portion of slide 56 is turned down into overlying relation with left frame sideplate 44 and is provided with an elongated slot 56*b* in which is received the shank of a screw 56*c* (FIG. 2), completing the mounting of this slide to the mechanism frame. As will be seen, motivation of slide 56 to execute a rearward return stroke followed by a forward charging stroke is derived from the power unit assembly 24 via a pin 58 (FIG. 10) operating in a laterally extending slot 56*d* formed in this slide.

To couple the forward charging stroke of manual operator slide 50 to the circuit breaker operating mechanism, a transverse pin 60 serves to pivotally mount the rearward end of an elongated drive pawl 62 seen in FIG. 3. Similarly, motor operator slide 56 carries a transverse pin 64 pivotally mounting the rearward end of a second, identical drive pawl 66. A bell crank assembly, generally indicated at 68, includes a main shaft 68*a* rotationally mounted at its opposed ends by the frame slideplates 44. Pinned to this shaft are a pair of crank arms 71 and 72. Keyed to the left end of shaft 68*a* is an arm 74 which carries adjacent to its free end a headed pin 74*a* operating in an elongated slot 76*a* formed in a spring anchor 76 secured to the forward ends of a pair of powerful tension springs 78 seen in FIG. 2. Secured to the rearward ends of these tension springs is a spring anchor 80 which is affixed to the mechanism frame by a pin 81. Pinned to forward spring anchor 76 are a pair of elongated stop rods 82 which extend through the centers of tension springs 78 to abut against the rearward spring anchor 80. These stop rods are for the purpose of establishing a preloading of springs 78 of, for example, 100 pounds, and thus, when these springs discharge, the stop rods bottom out on the rearward spring anchor 80 before the spring convolutions can bottom out on themselves. This has the advantage of eliminating spring rebounding and also significantly reduces the potential for spring breakage.

Forward spring anchor 76, as seen in FIG. 2, is also provided with a laterally turned tab 76*b* which serves to anchor the forward end of a small tension spring 84. The rearward end of this spring is anchored by a screw 85 carried by the left frame sideplate 44. As will be seen, spring 84 serves to return bell crank assembly 68 to an appropriate starting angular position after springs 78 have discharged.

Still referring to FIGS. 2 and 3, pawl 62, pivotally connected to manual operator slide 50, is undercut to provide a notch 62*a* adapted to engage a pin 72*a* carried by crank arm 72 of bell crank assembly 68. It is thus seen that when slide 50 is propelled forwardly by clockwise cranking movement of manual handle 28, pawl 62 picks up pin 72*a*, causing the bell crank assembly to rotate in the clockwise direction. As will be seen from FIGS. 5 through 7, this action charges springs 78. In corresponding fashion, pawl 66, pivotally connected to motor operator slide 56, is undercut to provide a notch 66*a* which is adapted to pick up a pin 71*a* carried by bell crank arm 71 when this slide is motivated through a forward charging stroke by the motor operator assembly of FIG. 8. The bell crank assembly is thus rotated also in the clockwise direction effective to charge springs 78.

As will be seen from the description to follow, charging springs 78, once charged, are sufficiently forceful to overpower a spring powered breaker contact operating mechanism, such that the discharge of these springs is utilized to charge the contact operating mechanism springs which can then act to close and open the breaker contacts. Thus, the operator slides 50 and 56 do not operate directly on the breaker contact operating mechanism, but rather indirectly via the bell crank assembly 68 and the powerful charging springs 78. Moreover, as will become clear from the following description, charging mechanism 42 accommodates essentially indiscriminate stroking movements of operator slides 50 and 56, thus eliminating the need for any mechanical and/or electrical interlocking between the manual operating handle and the motor operator mechanism. This is achieved by virtue of the independent mounting of these operator slides and the utilization of separate drive pawls to propel the bell crank assembly pursuant to charging springs 78. Thus, should the motor operator mechanism stall at some point during charging of the charging mechanism, possibly due to loss of power, the charge can be completed by the manual operating handle.

Figure 4:
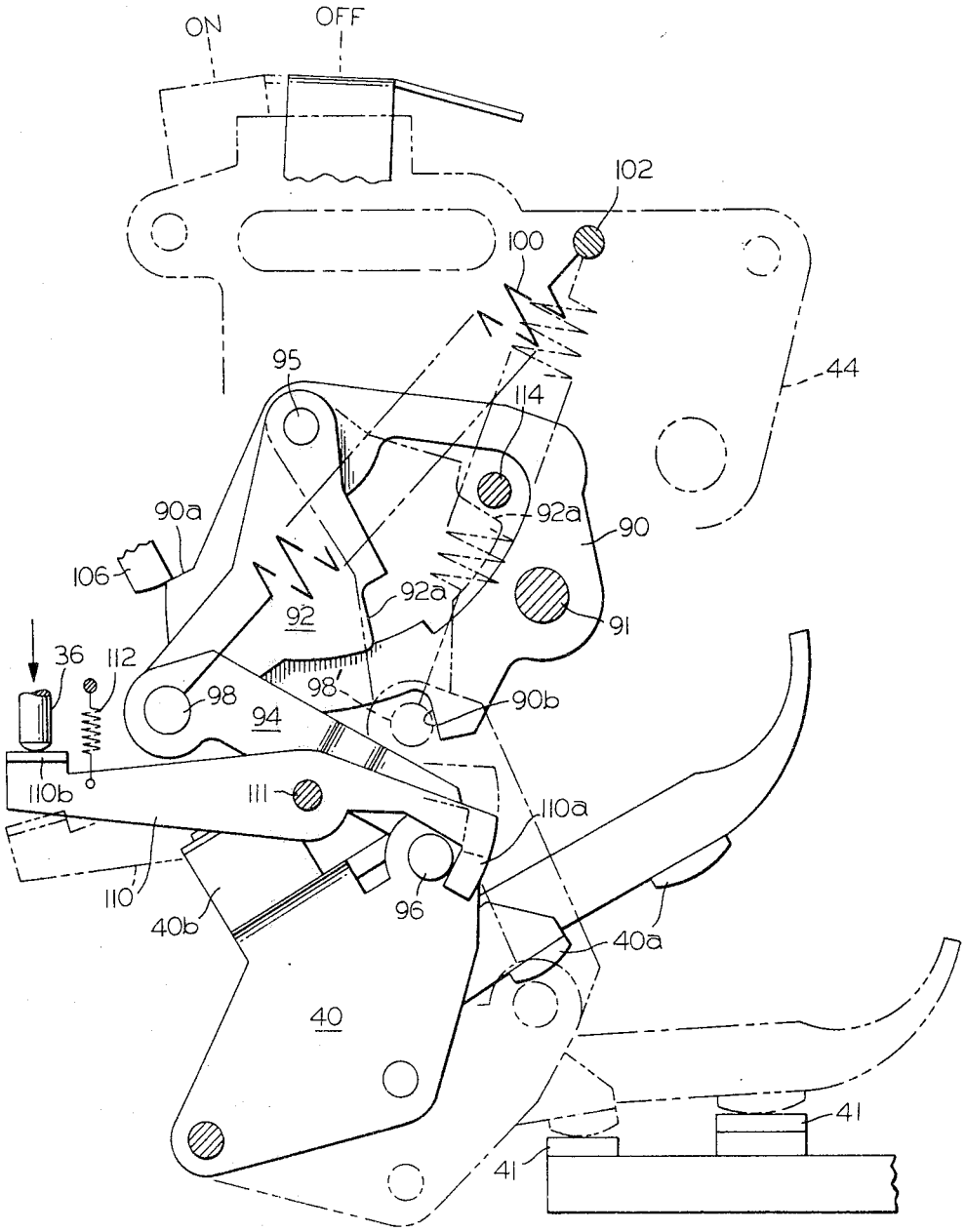
FIG. 4 is a side elevational view of the contact operating mechanism utilized in the circuit breaker of FIG. 1.

Contact operating mechanism of circuit breaker 20, seen in FIG. 4, is constructed basically in the same fashion as disclosed in the above noted U.S. Pat. No. 4,001,742. Thus, a cradle 90 is pivotally mounted on a pin 91 supported by the frame sideplates 44. A toggle linkage consisting of an upper link 92 and a lower link 94 connects cradle 90 to center pole movable contact assembly 40. Specifically, the upper end of link 92 is pivotally connected to the cradle by a pin 95, while the lower end of link 94 is pivotally connected to the center pole movable contact assembly by a pin 96. The other ends of these toggle links are pivotally connected by a knee pin 98. Mechanism tension spring 100 acts between the toggle knee pin 98 and a pin 102 supported between the frame sideplates 44. In practice there are two mechanism springs 100, one to each side of the cradle 90 to thus balance the spring forces on the mechanism parts. The toggle links 92 and 94 are also preferably provided in pairs.

From the description thus far, it will be noted that the major distinction in the construction of the contact operating mechanism of FIG. 4 herein and that disclosed in U.S. Pat. No. 4,001,742 is that the operating lever included in the latter to couple the operating slide to the cradle pursuant to charging the mechanism springs is omitted in the instant construction. In the absence of this operating lever, to which the upper ends of the mechanism spring were pinned in the patented construction, the upper end of mechanism springs 100 seen in FIG. 4 are anchored to a stationary point, namely pin 102 carried by the mechanism sideplates 44. As will be seen, the function of the operating lever in the patented construction is assumed by the bell crank assembly 68 of FIGS. 2 and 3 in articulating the cradle 100 pursuant to charging mechanism springs 100. Moreover, by virtue of the position of spring anchoring pin 102, the line of action of charged spring 100, while cradle 90 is in its latched reset position sustained by the engagement of a latch 106 with cradle latch shoulder 90*a*, is always situated to the right of the upper toggle link pivot pin 95. Thus, the mechanism springs continuously act to straighten the toggle. Since straightening of the toggle forces the movable contact assemblies 40, ganged together by crossbar 40*b*, to pivot downwardly to their phantom line, closed circuit positions with their movable contacts 40*a* engaging stationary contacts 41, circuit breaker 20 is biased toward contact closure while cradle 90 is reset.

To control the moment of contact closure, a hook 110 is provided to hold movable contact assemblies 40 in a hooked open circuit position as the cradle is being reset from a clockwise-most tripped position to charge mechanism spring 100, thereby maintaining the toggle collapsed to the left as seen in FIG. 4. This hook is pivotally mounted on a pin 111 with its right hooked end 110*a* configured to engage pin 96 carried by the center pole movable contact assembly 40. A spring 112 biases the hook into engaging relation with pin 96. The left end of hook 110 is provided with a laterally turned flange 110*b* positioned to be engaged by the lower end of ON pushbutton 36 of FIG. 1 to release the movable contact assemblies 40 for contact closure as spring 100 abruptly straightens toggle links 92, 94. While not shown in FIG. 4, the center pole movable contact assembly carries a control surface to hold hook 110 in its phantom line release position so as not to interfer with pin 96 during counterclockwise opening movement of the contact assemblies. An example of such a hook control surface may be found in U.S. Pat. No. 4,128,750.

With the movable contact operating mechanism parts in their phantom line, closed circuit position seen in FIG. 4, toggle knee pin 98, seen in phantom at 98', engages a shoulder 90*b* of cradle 90 while latched in its reset position by latch 106. This shoulder serves as a stop to prevent the toggle from snapping over center and in fact stops the toggle just short of its fully straightened position. It will also be noted that with the contacts in their closed circuit positions, a shoulder 92*a* formed in upper toggle link 92 is positioned, as indicated at 92*a*, in contiguous relation with a stationary pin 114. Thus, when cradle 90 is released by a latch 106, either in response to depression of OFF pushbutton 34 of FIG. 1 or automatically in response to an overcurrent condition sensed by the circuit breaker's trip unit, clockwise pivotal movement of the cradle toward its tripped position under the urgence of mechanism spring 100 brings the upper toggle link shoulder 92*a* into engagement with pin 114, thereby accelerating the rate of collapse of the toggle. This action produces abrupt and accentuated separation of the circuit breaker contacts under the urgence of the discharging mechanism spring 100. Also contributing to the speed with which contact separation is achieved is the fact that the cradle shoulder 90*b* stops the toggle linkage short of its fully straightened condition while the breaker contacts are closed, as previously noted. Since the toggle does not have to snap through center to start the contact opening movement of the movable contact assemblies 40, contact separation is achieved that much more rapidly. That is, the initial movement of the toggle linkage upon unlatching of the cradle starts the collapse of the toggle which is further accentuated by the presence of pin 114. Contact separation is thus initiated without hesitation. In fact, under high fault conditions, contact separation may be initiated by the electromagnetic forces associated with the high fault currents prior to release of the cradle. It is seen that the toggle can accommodate this initial, forced contact separation by immediately beginning its collapse and the cradle, upon its release, catches up with the collapsing toggle linkage in completing the interruption without contact reclosure.

Figure 5:
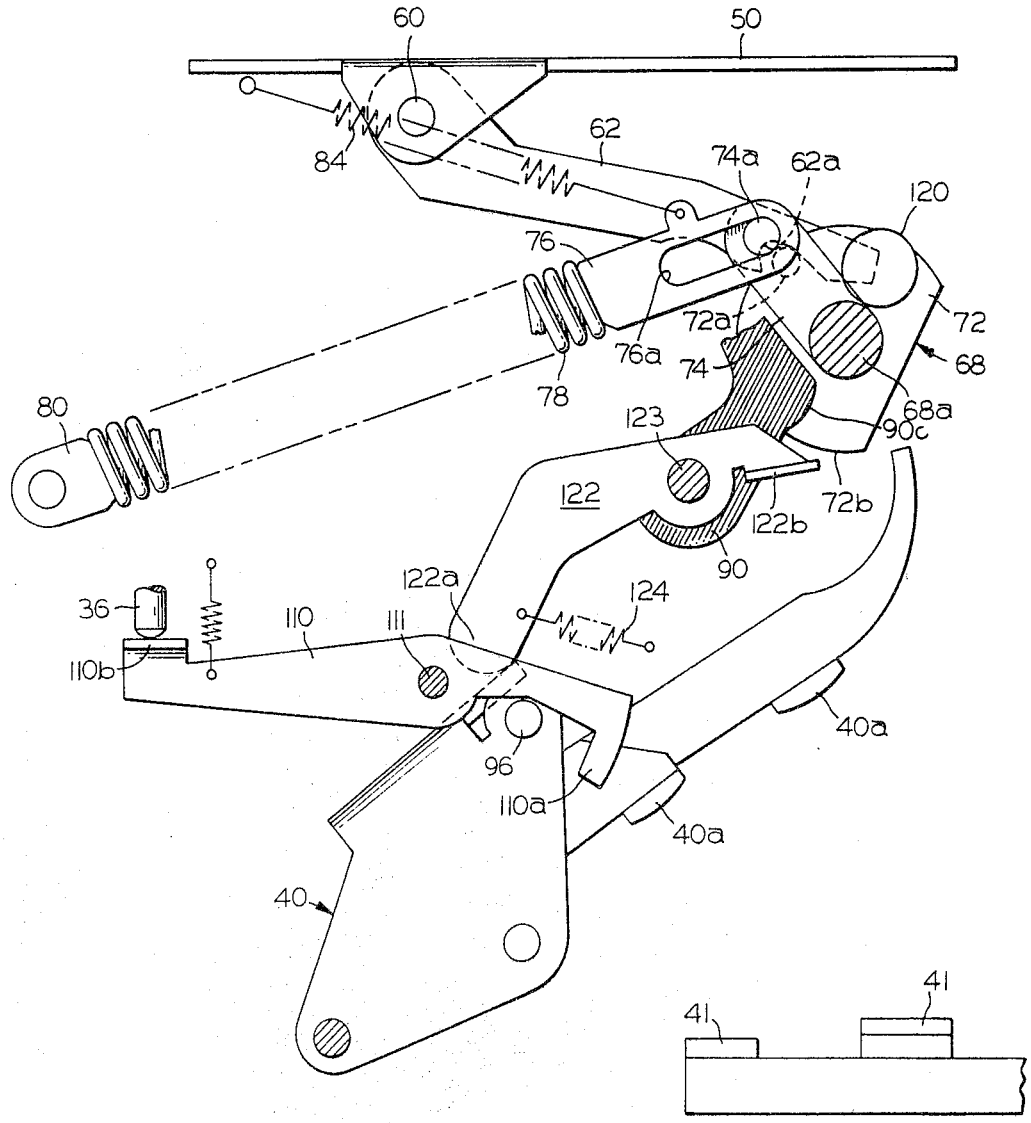
FIG. 5 is a simplified, side elevational view of the charging mechanism and the contact operating mechanism as the former is about to be charged.
Figure 6:
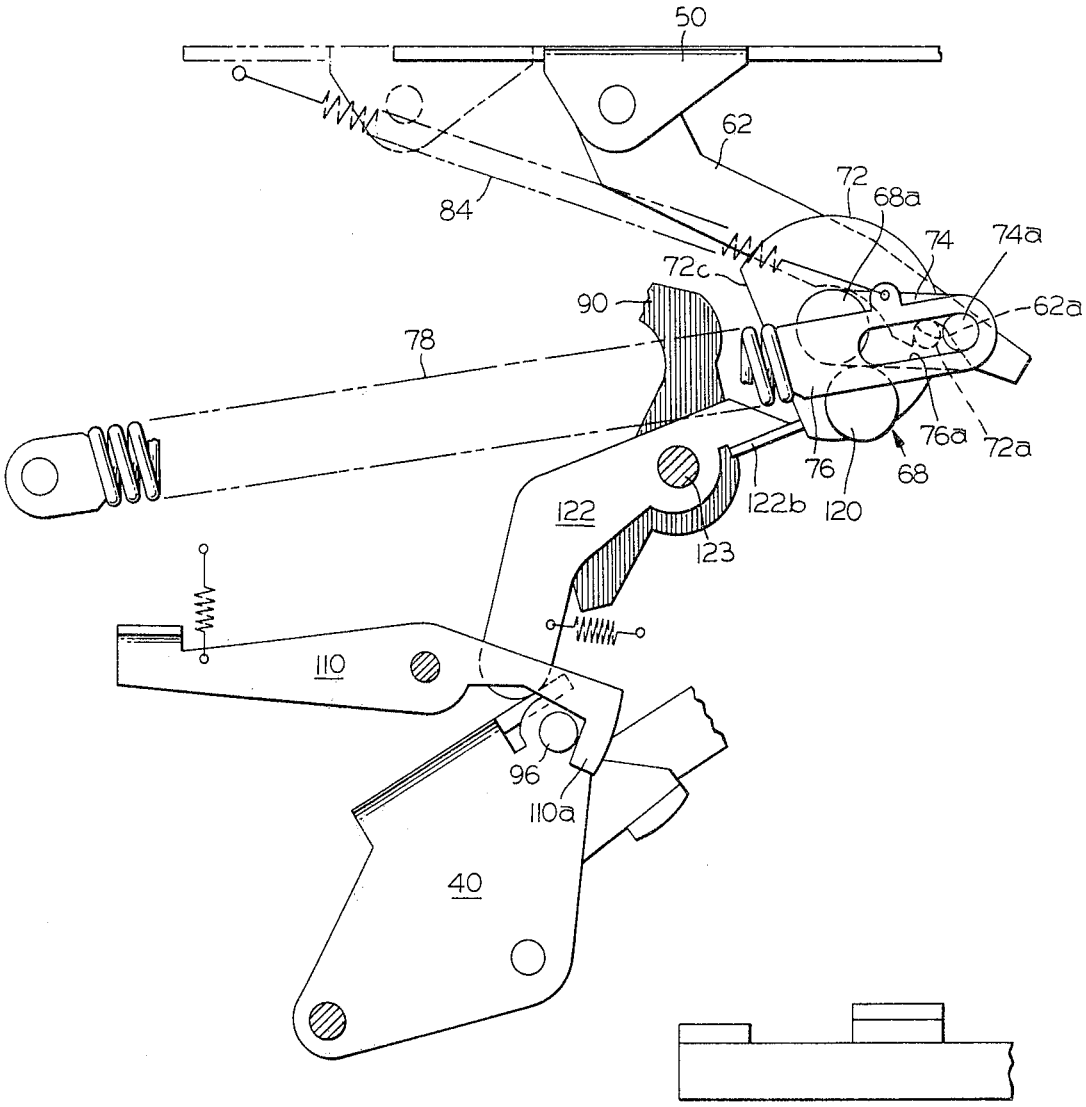
FIG. 6 is a simplified, side elevational view of the charging and contact operating mechanisms with charges stored in both mechanisms.
Figure 7:
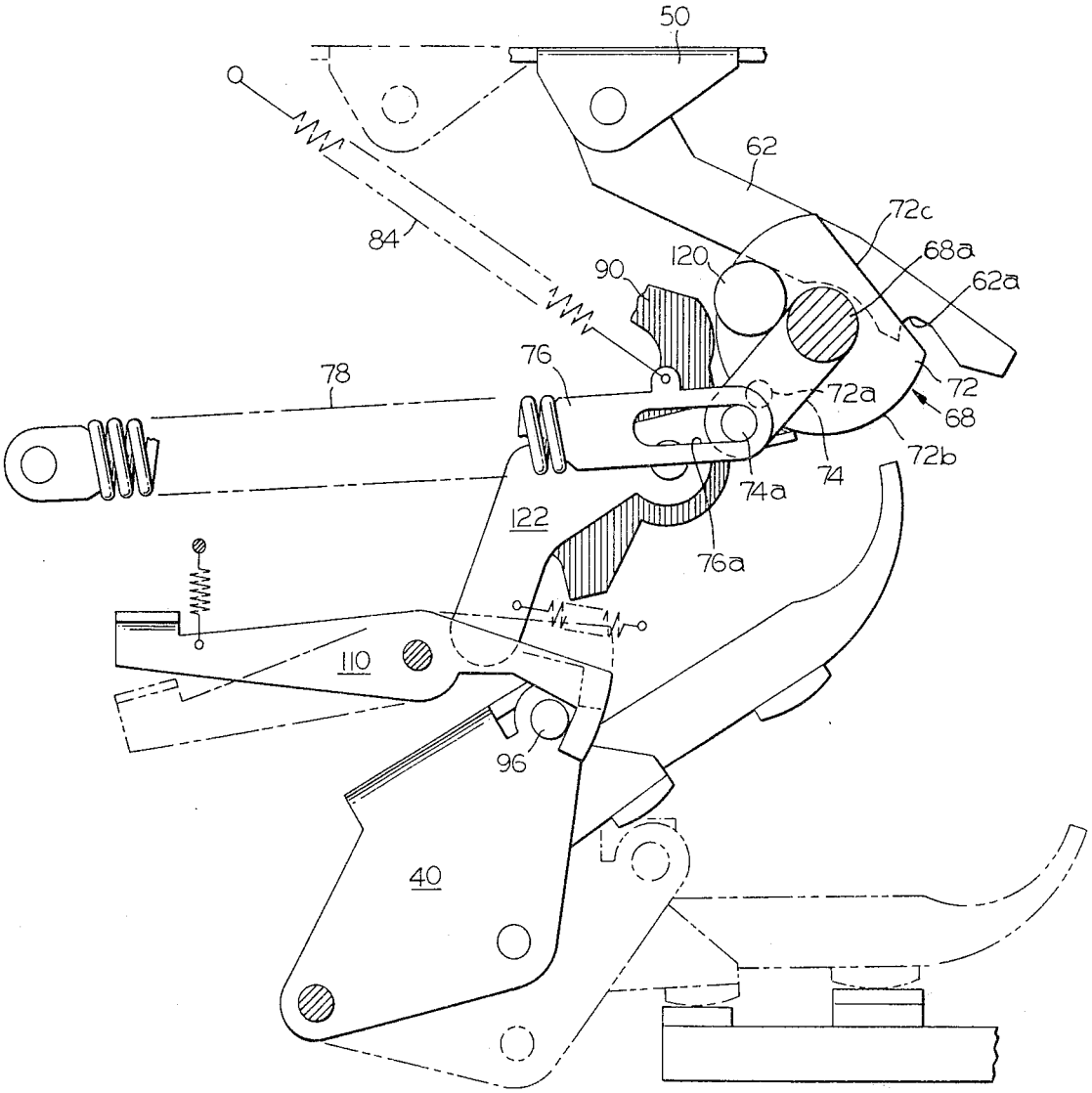
FIG. 7 is a simplified, side elevational view of the charging and contact operating mechanisms wherein the former is discharged and the latter is charged.

Reference is now had to FIGS. 5 through 7 for a description of the overall operation of the circuit breaker 20 of FIG. 1 and specifically the operation of the charging mechanism in resetting the contact operating mechanism of FIG. 4 pursuant to charging its spring 100. It will be recalled that the contact operating mechanism spring 100 is charged when cradle 90 is swung about its pivot pin 91 in the counterclockwise direction from a clockwise-most tripped position to bring its latching shoulder 90*a* into engagement with latch 106. To induce this resetting pivotal movement of cradle 90, the bell crank assembly 68, best seen in FIGS. 2 and 3, is provided with a reset roller 120 eccentrically mounted between the bell crank arms 71 and 72. As will be seen, when charging springs 78 discharge, bell crank assembly 68 is rotated to swing the reset roller around to engage cradle 90 while in its tripped position, driving it in the counterclockwise direction to its reset position, in the process charging the contact operating mechanism spring 100.

Referring first to FIG. 5, bell crank assembly 68 is seen in a start angular orientation achieved by the action of tension spring 84. Manual operator slide 50 is shown in its left-most return position with its pawl 62 retracted to a position where its notch 62*a* is in intercepting relation with pin 72*a* carried by crank arm 72 of bell crank assembly 68. At this point it should be pointed out that motor operation slide 56 and its drive pawl 66 act on bell crank assembly 68 in the same fashion as the manual operator slide and its drive pawl 62. Thus, the operation to be described in connection with FIGS. 5 through 7 applies whether it is initiated by reciprocation of manual operator slide 50 or motor operator slide 56. The only distinction is that the motor operator drive pawl 66 engages pin 71*a* carried by crank arm 71, whereas the manual operator drive pawl 62 engages pin 72*a* carried by crank arm 72.

From FIG. 6, it is seen that when slide 50 is driven to the right through a charging stroke by clockwise cranking movement of manual operating handle 28, drive pawl 62 is pushed to the right. Its notch 62*a* picks up pin 72*a*, causing bell crank assembly 68 to be rotated in the clockwise direction. When the bell crank assembly reaches its angular position of FIG. 6, it is seen that charging springs 78 are stretched to a charged state. It is assumed, at this point in the description, that the movable contact operating mechanism of FIG. 4 is tripped, and thus cradle 90 is in its clockwise-most tripped position seen in FIG. 5. Under these circumstances, the essentially discharged contact operating mechanism spring 100 has lifted the movable contact assemblies 40, to a counterclockwise-most, tripped open position seen in FIG. 5. In this position, the top surface of the center pole movable contact assembly engages and lifts the left lower end 122*a* of a prop 122 pivotally mounted intermediate its ends on a pin 123. The other, upper end 122*b* of this prop is moved downwardly out of an engaging relation with the arcuate surface portion of one of the bell crank arms against which it is normally engaged under the bias of a return spring 124. While in FIG. 7, prop 122 is shown as being biased into engagement with the arcuate surface portion 72*b* of crank arm 72, in practice, prop 122 acts against crank arm 71 simply as a matter of structural convenience.

As seen in FIG. 6, the rightward charging stroke of operator slide 50 is sufficient to carry the line of action of charging springs 78 through the axis of the bell crank assembly shaft 68*a*. Consequently, with prop 122 in its FIG. 5 position, the charging springs immediately discharge and the bell crank assembly is thereby driven in the clockwise direction, swinging reset roller 120 into engagement with a nose 90*c* of cradle 90 in its tripped position of FIG. 5. The cradle is thus swung in the counterclockwise direction to its reset position as the discharging springs 78 drive the bell crank assembly to its angular position seen in FIG. 7. As cradle 90 is being reset, contact operating mechanism spring 100 is charged to exert a bias tending to drive the movable contact assemblies 40 to their closed circuit positions seen in phantom in FIG. 7. However, hook 110 is in position to intercept pin 96 and detain the movable contact assemblies in a hooked open position seen in FIGS. 6 and 7. In this hooked open position, the center pole contact assembly releases the lower end 122*a* of prop 122, and its return spring 124 urges the other end 122*b* thereof into engagement with the arcuate surface portion 72*b* of bell crank arm 72 as seen in FIG. 7. By virtue of the loss motion coupling between bell crank assembly 68 and charging spring 78 afforded by slot 76*a* in its anchor 76, spring 84 acts to continue the clockwise rotation of bell crank assembly 68 from its angular position of FIG. 7 around to its start position of FIG. 5 with pin 74*a* again bottomed against the right end of slot 76*a* in charging spring anchor 76.

From the description thus far, it is seen that the first charge-discharge cycle of charging springs 78 has been effective in resetting the contact operating mechanism cradle 90 and charging the spring 100 thereof, but the breaker contacts are sustained in their open circuit positions by hook 110. At this point, the operator slide 50 can be motivated by handle 28 through a second rightward charging stroke to again charge springs 78. Since movable contact assemblies 40, in their hooked open position, have released prop 122, its upper end 122*b* rides off arcuate surface portion 72*b* of bell crank arm 72 as the bell crank assembly is rotated in a clockwise direction. Spring 124 serves to elevate end 122*b* of prop 122 into intercepting relation with the flattened surface 72*c* of bell crank arm 72 at the conclusion of the operator slide charging stroke just as the line of action of the charging springs 78 passes below the axis of bell crank assembly shaft 68*a*. Thus, as seen in FIG. 6, prop 122 serves to prevent further clockwise rotation of the bell crank assembly 68, and the charging springs 78 are held in a fully charged condition. It is thus seen that while the breaker contacts are held in their hooked open circuit position by hook 110, both the charging springs 78 and contact operating mechanism spring 100 are poised in their fully charged conditions. At this point, ON pushbutton 36 may be depressed, causing hook 110 to release the movable contact assemblies 40, whereupon they pivot to their closed circuit position under the urgence of mechanism spring 100. It will be noted that closure of the movable contacts has no effect on prop 122, and thus charging springs 78 are sustained in their fully charged condition.

When the circuit breaker 20 is eventually tripped open, either by depression of OFF pushbutton 34 or operation of the circuit breaker trip unit in response to an overcurrent condition, the unlatched cradle 90 swings to its tripped position, and the movable contact assemblies 40 abruptly pivot upwardly to their tripped open position of FIG. 5, all under the urgence of the discharging contact operating mechanism spring 100. As the center pole movable contact assembly 40 moves to its tripped open position, it picks up the lower end of prop 122, ducking its upper end 12*b* out of engagement with the flat peripheral surface portion 72*c* of crank arm 72. The clockwise rotational restraint on the bell crank assembly 68 is thus removed, and charging springs 78 abruptly discharge, swinging reset roller 120 around to drive cradle 90 from its tripped position of FIG. 5 back to its reset position of FIG. 7. The contact operating mechanism spring 100 is again charged, and the movable contact assemblies 40 moved to their hooked position seen in FIG. 6. At this point, the charging springs 78 may again be charged, and the charge therein will be automatically stored by prop 122 until needed to recharge the contact operating mechanism spring 100. Alternatively, and more significantly, hook 110 may be articulated by ON pushbutton 36 to precipitate closure of breaker 20, and thereafter the breaker may be tripped open without charging the charging springs 78.

From the foregoing description, it is seen that with the breaker contacts open and its contact operating mechanism tripped, the charging springs can be put through a first charge-discharge cycle to charge to contact operating mechanism spring 100 and then a second charge which is stored by prop 122 until needed to re-charge the mechanism spring 100. Thus, circuit breaker 20, starting in its tripped open condition and with two chargings of charging springs 78, can be closed, tripped open, reclosed and tripped open again without an intervening charging of the charging springs. It follows from this that the charging springs can be charged with the breaker contacts closed to achieve open, closed and open operations of the circuit breaker without an intervening charge.

Figure 8:
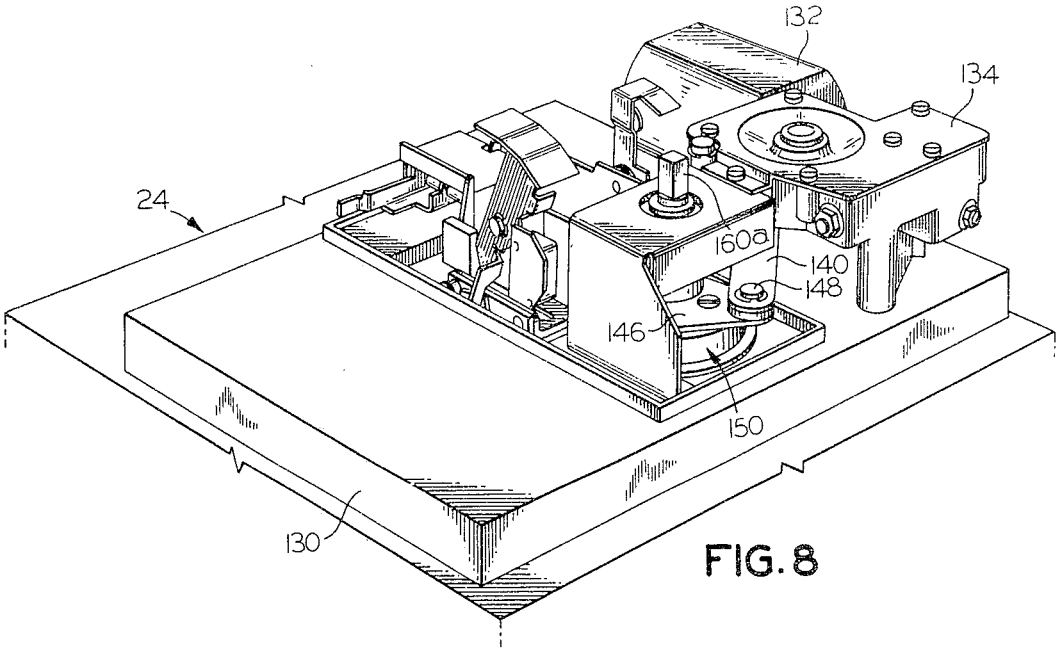
FIG. 8 is a perspective view of the motor operator mechanism utilized in the circuit breaker of FIG. 1.
Figure 9:
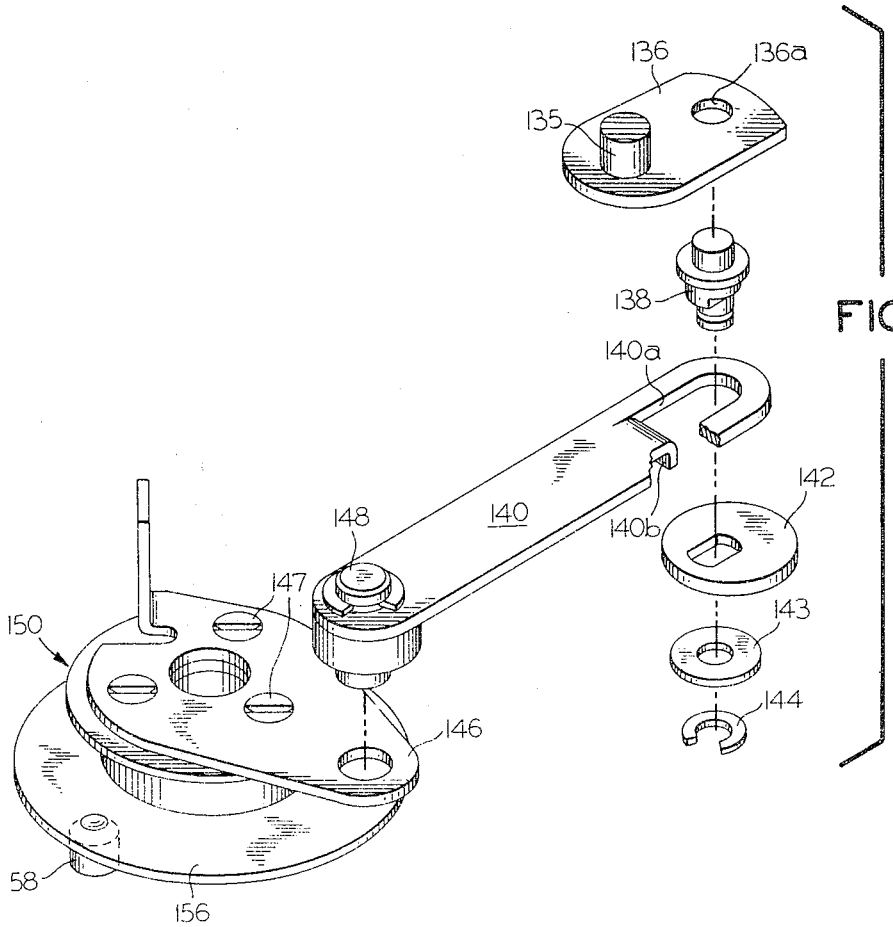
FIG. 9 is a perspective assembly view of a variable drive coupling link assembly utilized in drivingly coupling the motor operator mechanism of FIG. 8 to the circuit breaker charging mechanism.

The essential elements of power unit assembly 24 of FIG. 1 operating to reciprocate motor operator 56 in FIGS. 2 and 3 are shown in detail in FIGS. 8 through 13. Thus, as seen in FIG. 8, the power unit assembly 24 includes a molded insulative base 130 which, as seen in FIG. 1, is sandwiched between circuit breaker base 38 and the cover assembly cover. Supported atop this base is an electric motor 132 whose output shaft is drivingly connected to the input shaft (not shown) of a gear box 134. The construction of this gear box may take the form disclosed in above-noted U.S. Pat. No. 4,042,896. Keyed to the gear box output shaft, indicated at 135 in FIG. 9, is a crank arm 136. Adjacent the free end of this crank arm is a hole 136*a* in which the head of a shouldered pin 138 is inserted and peened over to fixedly secure it in place. The shank of this pin extends through an elongated longitudinal slot 140*a* in a link 140. A circular cam 142 is keyed on the shank of pin 138 in position below link 140. Finally, a washer 143 is inserted on the lower end of pin 138 and a snap ring 144 clipped in the very end retains the pin captured in slot 140*a* in link 140. The other end of link 140 is pivotally connected to a crank arm 146 by a pin 148. Crank arm 146 is secured by screws 147 to a hub assembly, generally indicated at 150 and mounted by base 130 of power unit assembly 24.

Referring to FIG. 10, hub assembly 150 includes an outer hub 152 which is received in an opening 130*a* provided in the power unit assembly base 130. An upper flange plate 154 is secured to the upper end of hub 152 by the screws 147 securing crank arm 146 to the hub assembly. A lower flange plate 156 is secured to the lower end of hub 152 by screws 157. It is thus seen that these flange plates serve to capture outer hub 152 for rotational movement in opening 130*a* of power unit assembly base 130. Pin 58, operating in slot 56*d* of motor operator slide 56, is eccentrically mounted to lower flange 156. As will be seen, the unidirectional rotation of the gear box output shaft 135 (FIG. 9) results in oscillatory rotation movement of outer hub 152 pursuant to reciprocating motor operator slide 56.

Still referring to FIG. 10, outer hub 152 and flange 154 are provided with respective central openings 152*a* and 154*a* in which is received a female square drive member 158. Integrally formed with this female drive member for upward extension through a reduced diameter opening 146*a* in crank arm 146 is a stub shaft 160 which terminates in a male square drive member 160*a* seen in FIG. 8. A snap ring 161 cooperates with the shoulder 162 between member 158 and stub shaft 160 to capture these elements in hub assembly 150 for rotational movement as an inner hub independently of outer hub 152. The upper, male square drive member end 160*a* of stub shaft 160 accommodates rotational drive coupling engagement with handle 28 when cover assembly 26 is assembled in place. Stub shaft 48, previously mentioned in connection with FIG. 2, is clearly shown in FIG. 10 with its reduced diameter lower end portion 48*a* journalled in a bore 46*a* provided in block 46. Crank arm 52 is affixed to this reduced stub shaft portion as is a flange 164 which cooperates with a snap ring 165 in capturing stub shaft 48 in mounting block bore 46*a* for rotational movement. As previously described, crank arm 52 mounts pin 54 which operates in slot 50*b* of manual operator slide 50. The upper end of stub shaft 48 is in the form of a male square drive member 48*b* which is received in the square sided central hole 158*a* provided in female square drive member 158 pursuant to drivingly coupling stub shaft 160 with stub shaft 48 and thus handle 28 with manual operator slide 50.

As will be seen in the following description in conjunction with FIGS. 11 through 13, a motor operator mechanism charging cycle is executed by swinging crank arm 136 through a full 360° revolution. During the initial portion of each crank arm 360° revolution, motor operator slide 56 is propelled from a home position through a return stroke, retract its pawl 66 into position where it can pick up pin 71a carried by a crank arm 71 of the bell crank assembly 68 (FIG. 3). During the concluding portion of each 360° revolution, slide 56 is driven forwardly through a charging stroke back to its home position, whereupon bell crank assembly 68 is rotated in the clockwise direction (FIGS. 5 through 7), pursuant to charging charging springs 78. As will be seen, link 140 is jointly acted upon by pin 138 and circular cam 142 so as to provide a lost motion coupling between the link and crank arm 136 effectuated at the conclusion of the motor operator slide charging stroke to decouple link 140 from crank arm 136. This lost motion coupling provides a coasting zone during which the de-energized motor 132 of FIG. 8 is permitted to coast to a stop without disturbing the motor operator slide home position achieved at the conclusion of its charging stroke. By virtue of this coasting zone, the necessity for special braking provisions to abruptly stop rotation of the motor output shaft at the conclusion of a charging cycle are rendered unnecessary. This constitutes a distinct advantage in terms of design efficiency and field reliability. Paradoxically, it will be seen that this coasting zone is achieved while maintaining equal clockwise and counterclockwise throws of crank 146, and thus equal length return and charging strokes of motor operator slide 56.

Figure 11:
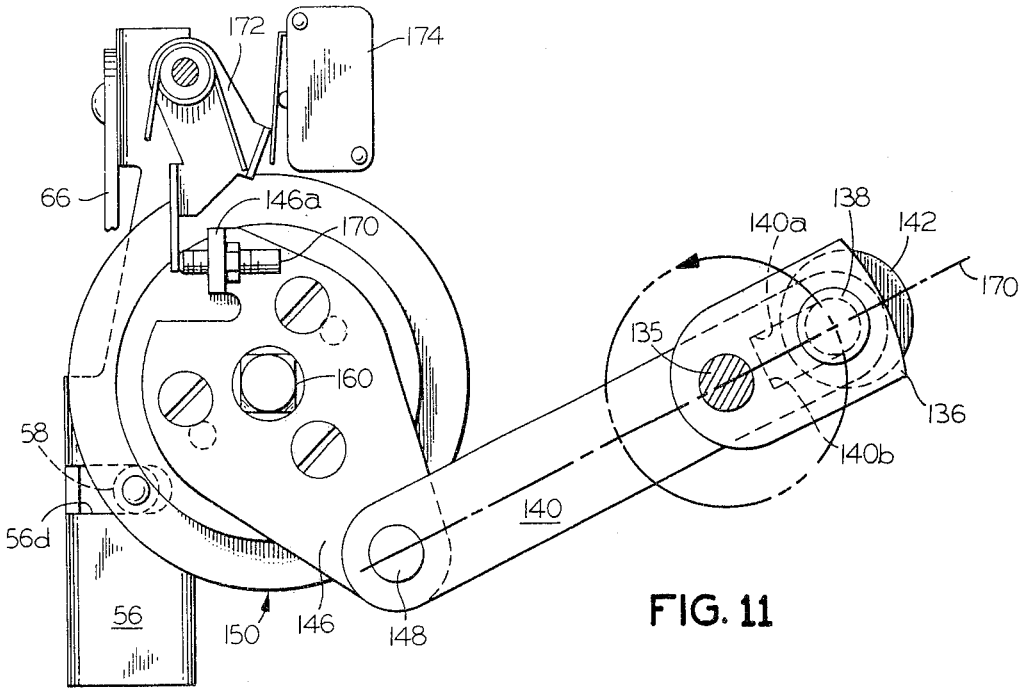
FIG. 11 is a simplified plan view of the link assembly of FIG. 9 at the conclusion of motor operator mechanism charging of the charging mechanism.

The motor operator mechanism drive parts are shown in FIG. 11 with the axes of gear box output shaft 135, pin 138 and pin 148 in alignment along a center line 170. Since pin 138 is aligned on the opposite side of output shaft 135 from pin 148, crank arm 146 has arrived at the end of its counterclockwise throw, and motor operator slide 56 has reached the end of its forward charging stroke, which is direction downwardly in FIG. 11. It will be noted that pin 138 is bottomed against the outer end of slot 140*a* in link 140, while the periphery of eccentrically mounted circular cam 142 is spaced from the inner end of this slot constituted by a downward turned tab 140*b* best seen in FIG. 9. As crank arm 136 is rotated in the counterclockwise direction by gear box output shaft 135 away from center line 170, pin 138 moves away from the outer end of slot 140*a*, and link 140 is simply swung in the counterclockwise direction about pin 148. It is not until the periphery of circular cam 142 moves into engagement with tab 140*b* at the inner end of slot 140*a* that any effective driving force is exerted on link 140 to swing crank 146 in the clockwise direction to begin a return stroke of motor operator slide 56 away from its home position. There is thus provided a lost motion connection between crank arm 136 and link 140 which creates a coasting zone through which crank arm 136 may revolve without exerting any driving force on crank arm 146 tending to move slide 56 from its home position. Thus, when pin 138 is revolved to its position in FIG. 11, motor 132 in FIG. 8 may be de-energized and simply allowed to coast to a stop without disturbing the home position of slide 56. Under these circumstances, special provisions to abruptly brake the motor at the conclusion of a slide charging stroke and thereby preserve the slide home position is rendered unnecessary.

To this end, crank arm 146 is provided with an upwardly turned flange 146*a* through which is adjustably threaded a set screw 170. When the parts are in their position shown in FIG. 11, screw 170 engages and pivots a lever 172 into actuating engagement with a normally closed switch 174. Upon actuation of this switch, the energization circuit for motor 132 is interrupted, and it is simply permitted to coast to a stop.

Figure 12:
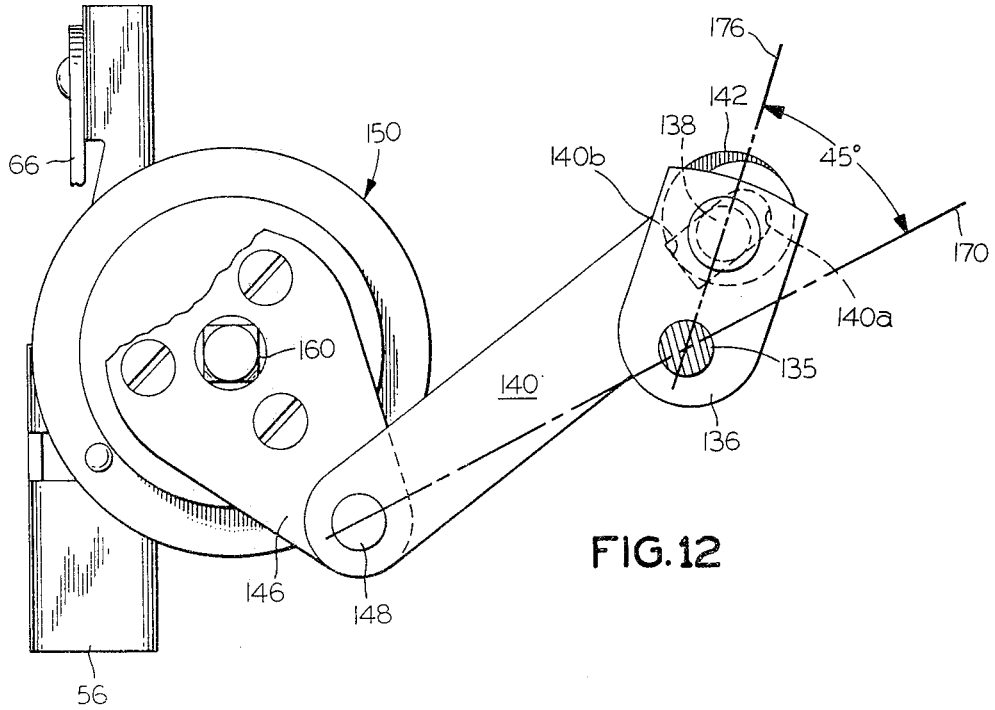
FIG. 12 is a simplified plan view of the link assembly of FIG. 9 at the beginning of a charging mechanism charging cycle.

In FIG. 12, the parts in FIG. 11 are seen in their positions assumed at the end of the coasting zone when the periphery of cam 142 has just moved into engagement with tab 140*b* at the inner end of slot 140*a*. In the illustrated embodiment, the configuration and dimensions of cam 142 is such as to provide a coasting zone of approximately 45° through which crank arm 136 can swing from centerline 170 to centerline 176 without exerting any driving force on crank arm 146. It is apparent that when cam 142 engages tab 140*b*, only then is driving force exerted on link 140, propelling crank arm 146 through its clockwise throw pursuant to initiating motor operator slide 156 return stroke away from its home position. It is noted that initially this driving force is exerted through a shortened effective driving length in link 140.

Figure 13:
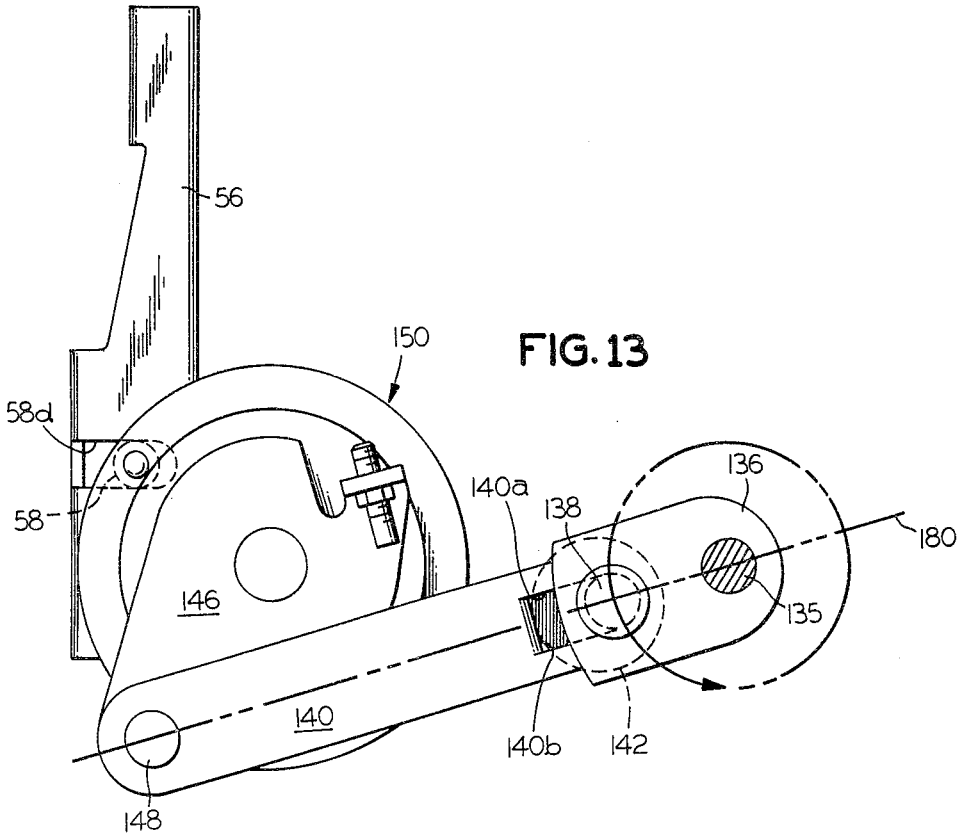
FIG. 13 is a simplified plan view of the link assembly of FIG. 9 as the charging mechanism is about to be charged.

In FIG. 13, the motor operator drive parts are shown in their positions assumed at the end of the clockwise throw of crank arm 146 to conclude the return stroke of slide 56. The axes of pin 148, gear box output shaft 135 and pin 138 are now aligned along a center line 180, with pin 138 between pin 148 and shaft 135. It is significant to note that circular cam 142 is now angularly oriented with its peripheral surface of maximum radius in engagement with tab 140*b*. This maximum radius is selected such as to return pin 138 into engagement with the outer end of slot 140*a* in link 140, thereby reestablishing this link to its full effective driving length. Consequently, the abrupt reduction in effective length of link 140 utilized during the coasting zone is progressively restored to its full driving length by the conclusion of the return stroke of the slide 66. Since the return stroke is very lightly loaded, the loss of mechanical advantage occasioned by the reduction in effective driving length is of no concern.

With continued counterclockwise position of crank arm 136 from its position seen in FIG. 13, it is seen that pin 138 is bottomed against the outer end of slot 140*a* in link 140, and crank arm 146 is pulled through its counterclockwise throw pursuant to propelling slide 56 through its forward charging stroke. When crank arm 136 swings back around to its position seen in FIG. 11, bringing the axis of pin 138 back into alignment with center line 170, the charging stroke is concluded. Slide 56 is thus returned to its home position, and, switch 174 is actuated. Motor 132 coasts to a stop, again without exerting the driving force of the crank arm 136 on motor operator slide 56 to disturb its home position.

Since by the conclusion of the operator slide return stroke (FIG. 13), link 140 has been restored to its full effective driving length (pin 138 bottomed against the outer end of link slot 140*a*), and this full effective driving length is sustained during the slide charging stroke, clockwise and counterclockwise throws of crank arm 146 are equal, as are the lengths of the operator slide return and charging strokes.

It will be appreciated that the operational effect of the pin 138 - cam 142 with link slot 140*a* can be provided in other ways to achieve the desired coasting zone. For example, link 140 may be constituted by a toggle which is controlled such as to partially collapse at the end of the slide charging stroke. Return stroke drive is initially effected through the partially collapsed toggle. The toggle is then progressively cammed back to its straightened condition by the end of the return stroke. The toggle remains in its fully straightened condition as the operator slide is pulled through its forward charging stroke by crank arm 136. Moreover, the pin-cam means may be carried by the link to function with a slot in the crank arm pursuant to effecting the requisite coasting zone accommodating lost motion coupling.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described the invention, what is claimed as new and desired to secure by Letters Patent is:

1. A circuit breaker comprising, in combination:

A. a manual operating handle;

B. a motor operator mechanism;

C. a slidingly mounted manual operator member drivingly coupled with said handle for motivation thereby through a reciprocating first operating cycle;

D. a slidingly mounted motor operator member drivingly coupled with said motor operator mechanism for motivation thereby through a reciprocating second operating cycle independent of said first operating cycle;

E. a contact operating mechanism including a mechanism spring capable of effecting breaker contact closure when charged and discharging to effect breaker contact opening; and F. a charging member drivingly coupling said manual operator member and said motor operator member with said contact operating mechanism such that execution of an operating cycle by either of said members effectuates charging of said mechanism spring.

2. The circuit breaker defined in claim 1, wherein said charging member is mounted for rotary motion in execution of a charging cycle effective in charging said mechanism spring, said charging member eccentrically mounting first and second driven elements, a first drive element connected with said manual operator member and engaging said first driven element during said first operating cycle to drive said charging member into its charging cycle, and a second drive element connected with said motor operator member and engaging said second driven element during said second operating cycle to also drive said charging member into its charging cycle.

3. The circuit breaker defined in claim 2, wherein said first and second driven elements are in the form of pins, and said first and second drive elements are in the form of pawls respectively pivotally connected with said manual operator member and said motor operator member.

4. The circuit breaker defined in claim 2, which further includes a charging spring connected with said charging member such as to be charged via either of said manual and motor operator members during a first portion of said charging member charging cycle, said charging spring discharging during the concluding portion of said charging member charging cycle to power the charging of said mechanism spring.

5. The circuit breaker defined in claim 4, wherein said first and second driven elements are in the form of pins, and said first and second drive elements are in the form of pawls respectively pivotally connected with said manual operator member and said motor operator member.

6. The circuit breaker defined in claim 4, which further includes means conditioned by said contact operating mechanism to prevent rotary motion of said charging member through the concluding portion of its charging cycle only when said mechanism spring is charged, thereby to releaseably sustain said charging spring in its charged condition.

7. The circuit breaker defined in claim 6, wherein said contact operating mechanism includes means selectively operable to prevent contact closure against the bias of said charged mechanism spring.

8. The circuit breaker defined in claim 5, which further includes a hub assembly comprising first and second hubs concentrically mounted for independent rotary movement, said first hub driving interconnecting said manual operating handle with said manual operator member and said second hub drivingly interconnecting said motor operator mechanism with said motor operator member.

9. The circuit breaker defined in claim 8, wherein the driving connection of said first hub with said manual operator member is in the form of an eccentric first pin driven by said first hub and received in a transverse slot formed in said manual operator member, whereby cranking motion of said handle in opposite directions reciprocates said manual operator member through a return stroke and a charging stroke during said first operating cycle.

10. The circuit breaker defined in claim 9, wherein the driving connection of said second hub with said motor operator member is in the form of an eccentric second pin driven by said second hub and received in a transverse slot formed in said motor operator member, whereby rotary motion of said second hub in opposition directions by said motor operator mechanism reciprocates said motor operator slide through a return stroke and charging stroke during said second operating cycle.

11. A circuit breaker comprising, in combination:

A. a manual operating handle;

B. a motor operator mechanism;

C. a first slide drivingly coupled with said handle and mounted for reciprocating movement thereby through a return stroke and a charging stroke;

D. a second slide drivingly coupled with said motor operator mechanism and mounted for reciprocating movement through a return stroke and a charging stroke independently of said first slide;

E. a contact operating mechanism capable of assuming reset and trip conditions, (1) at least one movable contact arm, and (2) a mechanism spring capable of being charged incident with conversion of said operating mechanism from its tripped condition to its reset condition, said charged mechanism spring powering contact closure movement of said arm with said operating mechanism in its reset condition and contact opening movement of said arm upon conversion of said operating mechanism from its reset condition to its tripped condition;

F. a charging member coupled with said contact operating mechanism and operative to convert same from its tripped to its reset condition during an operating cycle thereof, said charging member being independently drivingly coupled with said first and second slides such as to execute an operating cycle initiated by a charging stroke of either of said slides, as said charging member is propelled into its operating cycle by one of said slides, the other of said slides being drivingly decoupled from said charging member.

12. The circuit breaker defined in claim 11, wherein saidcharging member is mounted for rotary motion and in turn eccentrically mounts first and second driven elements, a first drive element connected with said first slide and drivingly engaging said first driven element to propel said charging member into its operating cycle as said first slide is driven through its charging stroke, and a second drive element connected with said second slide and drivingly engaging said second driven element to propel said charging member into its operating cycle as said second slide is driven through its charging stroke.

13. The circuit breaker defined in claim 12, wherein said first and second elements are in the form of pins, and said first and second drive elements are in the form of pawls respectively pivotally connected with said first and second slides.

14. The circuit breaker defined in claim 12, which further includes a hub assembly comprising first and second hubs concentrically mounted for independent rotary motion, said first hub drivingly interconnecting said handle with said first slide and said second hub drivingly interconnecting said motor operator mechanism with said second slide.

15. The circuit breaker defined in claim 12, which further includes a charging spring connected at one end to said charging member, said charging member, while rotated in one direction in response to a charging stroke by either of said slides, acting during the initial portion of its operating cycle to charge said charging spring, at the conclusion of a slide charging stroke said charging spring discharging to propel said charging member in the same rotational direction through the concluding portion of its operating cycle and to incidentally power the conversion of said contact operating mechanism from its tripped to its reset condition.

16. The circuit breaker defined in claim 15, which further includes prop means operative while said contact operating mechanism is in its reset condition to releaseably engage said charging member such as to prevent the rotation thereof through the concluding portion of its operating cycle, thereby to store the charge in said charging spring until said contact operating mechanism is converted from its reset condition to its tripped condition.

17. The circuit breaker defined in claim 16, wherein said contact operating mechanism further includes hook means selectively releaseably engaging said contact arm to restrain contact closure thereof while said contact operating mechanism is in its reset condition and its mechanism spring charged.

18. The circuit breaker defined in claim 15, which further includes a hub assembly comprising first and second hubs concentrically mounted for independent rotary motion, said first hub drivingly interconnecting said handle with said first slide and said second hub drivingly interconnecting said motor operator mechanism with said second slide.

19. The circuit breaker defined in claim 18, wherein the driving connection of said first hub with said first slide is in the form of an eccentric first pin driven by said first hub and received in a transverse slot in said first slide, whereby cranking motion of said handle in opposite directions drives said first slide through said return stroke to bring said first drive element into drive engaging relation with said first driven element and then through said charging stroke during which said first drive element engages said first driven element to propel said charging member into its operating cycle.

20. The circuit breaker defined in claim 19, wherein the driving connection of said second hub with said second slide is in the form of a second pin driven by said second hub and received in a transverse slot formed in said second slide, whereby rotary motion of said second hub in opposite directions by said motor operator mechanism drives said second slide through said return stroke to bring said second drive element into drive engaging relation with said second driven element and then through a charging stroke during which said second drive element engages said second driven element to propel said charge member into its charging cycle.

21. A circuit breaker comprising, in combination:

A. a manual operating handle;

B. a motor operator mechanism;

C. a manual operator member drivingly coupled with said handle for motivation thereby through a first operating cycle;

D. a motor operator member drivingly coupled with said motor operator mechanism for motivation thereby through a second operating cycle independent of said first operating cycle;

E. a movable contact operating mechanism; and

F. a charging member drivingly coupled with said movable contact operating mechanism to charge same incident with the execution of a charging cycle by said charging member, said manual and motor operator members being in independent and continuous drive coupling relations with said charging member such that said charging member is motivated into its charging cycle by whichever one of said operator members first initiates its operating cycle and motivated to the conclusion of its charging cycle by whichever one of said operator members first concludes its operating cycle, whereby said operating cycles of said operator members may be performed concurrently without the necessity for electrical and mechanical interlocking.

* * * * *